United States Patent [19]

Verschuur et al.

[11] 4,217,110

[45] Aug. 12, 1980

[54] PROCESS FOR PREPARING A SUSPENSION OF PARTICLES IN A HYDROCARBON OIL

[75] Inventors: Eke Verschuur, Amsterdam, Netherlands; Edward G. Masdin, London, England

[73] Assignee: Shell Oil Company, Houston, Tex.

[21] Appl. No.: 888,098

[22] Filed: Mar. 20, 1978

Related U.S. Application Data

[63] Continuation of Ser. No. 720,703, Sep. 7, 1976, abandoned.

[30] Foreign Application Priority Data

Sep. 9, 1975 [GB] United Kingdom ..... 37046/75

[51] Int. Cl.[2] ..... C10L 1/32

[52] U.S. Cl. ..... 44/51

[58] Field of Search ..... 44/51, 24, 23

[56] References Cited

U.S. PATENT DOCUMENTS

| | | | |
|---|---|---|---|
| 1,390,228 | 6/1921 | Bates | 44/51 |
| 1,390,230 | 6/1921 | Bates | 44/51 |
| 1,390,232 | 6/1921 | Bates | 44/51 |
| 1,929,860 | 10/1933 | Trent | 44/24 |
| 2,430,085 | 11/1947 | Spencer et al. | 44/51 |
| 4,126,426 | 11/1978 | Verschuur | 44/24 |
| 4,133,647 | 1/1979 | Burke | 44/24 |

FOREIGN PATENT DOCUMENTS

| | | | |
|---|---|---|---|
| 340337 | 1/1931 | United Kingdom | 44/51 |
| 458486 | 6/1936 | United Kingdom | 44/51 |
| 486088 | 5/1938 | United Kingdom | 44/51 |

*Primary Examiner*—Winston A. Douglas
*Assistant Examiner*—Y. Harris-Smith

[57] ABSTRACT

Coal particles suspended in water are agglomerated with a binder and the agglomerates are separated from the water and disintegrated in a liquid fuel.

11 Claims, No Drawings

PROCESS FOR PREPARING A SUSPENSION OF PARTICLES IN A HYDROCARBON OIL

This is a continuation of application Ser. No. 720,703, filed Sept. 7, 1976, now abandoned.

BACKGROUND OF THE INVENTION

The invention relates to a process for preparing a suspension of coal particles in a hydrocarbon fuel. Such suspensions make excellent fuels, and if the suspended coal particles are small enough, can be atomized as a liquid fuel in a burner. For the preparation of the suspensions the amount and particle size distribution of the solid must be chosen such that a dynamically and, if desired, statically stable suspension is obtained wherein the particles do not segregate or agglomerate. The ultimately allowable viscosity, too, puts limits to the amount and shape of the solid material in these suspensions. Within the scope of these limits, it is, however, very well possible to prepare attractive fuels.

Those skilled in the art will recognize that the solid material has to be distributed as homogeneously as possible through the hydrocarbon fuel. With the preparation of the suspensions the latter requirement gives rise to problems. It is difficult to mix an amount of dry coal powder homogeneously with the required amount of hydrocarbon fuel. This calls for a relatively large amount of energy and expensive equipment, one problem being the abrasive character of dry coal powder.

For application of the suspensions as fuel, it is desirable that the coal particles contain as little ash as possible. Since most coals contain a relatively high percentage of ash, the coal often has to be de-ashed before it can be made into the suspension. De-ashing also requires much energy and expensive equipment. The present invention aims at a combination of these two unrelated treatments to achieve considerable savings.

SUMMARY OF THE INVENTION

Accordingly, the suspension of coal particles in a hydrocarbon fuel is prepared by treating an aqueous suspension of ash-containing coal particles under turbulent conditions in an agglomeration device with a binder, preferably hydrocarbon based, resulting in the formation of agglomerates of coal particles and binder, while excluding at least part of the ash, separating the agglomerates obtained from an ash-containing water phase, and taking them up in a hydrocarbon fuel, the agglomerates being disintegrated and the resulting coal particles becoming suspended in the hydrocarbon fuel.

Thus, the coal is simultaneously de-ashed and brought into a form which is easily taken up in excess hydrocarbon fuel. Due to the presence of the binder in the agglomerates and to the fact that the agglomerates are much larger than the individual coal particles, the mixing of the coal (i.e. the agglomerates) with the hydrocarbon fuel proceeds much more easily than if dry coal powder would have to be mixed with the fuel. Possibly this is partly due to the fact that the coal particles have already been wetted with with hydrocarbon before the mixing when fuel takes place, i.e. during agglomeration.

DETAILED DESCRIPTION OF THE INVENTION

The method according to the invention starts from an aqueous suspension of coal particles. This suspension, whereof the percentage solids is not critical for the agglomeration step, can, for example, be a pipeline slurry. The aqueous suspension may have been obtained by grinding coal lumps wet, i.e. in the presence of water and—if desired—by mixing the obtained mass of ground coal with an extra amount of water. Wet grinding of coal lumps has some advantages over dry grinding; less energy is required, dust problems are eliminated and there is no explosion danger.

According to the invention, the process starts from an aqueous suspension of ash-containing coal particles. In this specification this is meant to denote an aqueous suspension of particles that consist mainly of coal. In this context it is then possible that the suspension contains coal particles which contain ash and/or that the suspension contains ash particles besides the coal particles. To a certain extent this depends on the history of the coal and the suspension in question.

As mentioned, the suspension is to be treated under turbulent conditions in an agglomeration device with a suitable binder. By contacting the suspension at normal or elevated temperature with a suitable binder and by stirring vigorously, agglomerates of coal particles and binder are formed. The binder should be of the type that is capable of causing coal particles to stick together, to the extent that the particles are wetted with the binder, are rendered hydrophobic and stick together. As indicated, hydrocarbon-based binders are preferred. The ash particles that are set free during the stirring, however, do not have such affinity for the binder and are to a great extent not taken up in the agglomerates. Due to the hydrophobic character of the agglomerates, it is relatively simple to separate them from the water phase, which separation could, for example, be effected by passing the stream of agglomerate-containing water, which originates from the agglomeration device, over a sieve on which the agglomerates remain. Also, it is possible, for example, to add in a separate mixing device an amount of hydrocarbons to the agglomerate-containing water phase, as that two phases are present in this mixing device and the agglomerates migrate from the water phase into the hydrocarbon phase. The agglomerates can then be transported while suspended in hydrocarbon. In all these cases, the ash-containing water phase may be separately withdrawn and processed.

The agglomerates are to be taken up in a hydrocarbon fuel. This can be done during and/or after the separation of agglomerates and water phase. The agglomerates can, after the said separation, for example, be mixed at once with the total amount of hydrocarbon fuel. The agglomerates can disintegrate and the mixture obtained is a homogeneous suspension of coal particles in hydrocarbon fuel. It is also possible to mix the agglomerates with a portion of the total required amount of hydrocarbon fuel, as a result of which a thick sludge is obtained which can subsequently be diluted with the remainder of the hydrocarbon fuel. The obtained suspension, if desired, can then be specially homogenized.

After separation of the agglomerates from the water phase, the agglomerates can suitably be disintegrated in the absence of the hydrocarbon fuel. This can, for example, be done in a mill. It is preferred, however, to disintegrate them while they are already mixed with at least part of the total required amount of hydrocarbon fuel.

For the process of the invention, all sorts of coal are, in principle, suitable, including the solid fuels that are related to coal, such as lignite, peat, bituminous coal, soot, coke, etc.

The hydrocarbon fuel may be one of the usual liquid fuels that are obtained from the processing of crude oil. The fuels based on heavy oil fractions, such as fuel oil, lend themselves especially well for application in the present process.

As a binder for the agglomeration of the coal particles a permanent binder may be chosen, i.e. a binder which is ultimately taken up in the fuel. It is also possible, however, to choose a type of binder that is regained from the agglomerates in the course of the process of the invention and which is then recirculated. This is possible, for example, by using a light hydrocarbon fraction as a binder and a heavy fraction as the fuel. The agglomerates may then be mixed with the fuel at a temperature above the boiling point or range of the binder, whereby the binder can be regained.

Suitable binders are, in principle, all liquids, or substances that are liquid at agglomerative conditions, which are wholly or partly based on hydrocarbons, provided they have the other suitable properties. This holds for all kinds of products obtained from oil or coal, such as naptha, gas oil, fuel oil, bitumen, coal tar, etc.

It is by all means possible, in principle, to use the applied fuel also as a binder.

Depending on the concentration of solids in the aqueous suspension, on the type of binder used and the applied amount and on the flow conditions, during stirring, various types of agglomerates may be obtained, ranging from loosely bound, fluffy material to hard pellets.

It has been experienced that complete deashing or deashing to the required degree may not always be reached at once, especially in cases where a high percentage of ash is originally present in the coal. In this case it is preferred according to the invention to mix the obtained agglomerates after separation from the ash-containing water phase with an additional amount of water and additional binder, to disintegrate the agglomerates and to re-agglomerate the coal under turbulent conditions, whereafter the fresh agglomerates are separated from the ash-containing water and taken up in the hydrocarbon fuel. Thus an additional deashing is obtained. The agglomerates can be disintegrated before, during and/or after addition of extra water in the first stage and addition of hydrocarbon fuel in the second stage.

It has also been found disadvantageous to perform the first agglomeration step of the above-mentioned two stage agglomeration process in a high sheer agglomeration device in which, apart from the agglomeration itself, the coal particles are further ground, whereby even more ash particles are liberated and thus separated. The suspensions obtained have a superior long term stability.

The invention will be further elucidated by two examples.

EXAMPLE I

One kg. of a coal slurry containing 200 grams of ash-containing coal particles (all smaller than 500μ, total ash content of 56% w) was agglomerated in a bench scale pelletizer (one liter vessel; power input 10 Watt) with 20 gram of 800 sec.R/ heavy fuel oil to small (1 mm) pellets. After screening, the pellets retained on the sieve were found to contain 25% w of water and 18% w ash on dry, binder free, basis. The wet pellets, approximately 150 grams, were mixed with 100 gram of heavy fuel oil. The thus formed suspension remained stable for two hours. Thereafter settling started, which halted after approximately two days when still approximately 80% of the coal was found to be in suspension.

EXAMPLE II

One kg. of slurry as prepared in Example I was allowed to settle until a virtually stable settled bed of coal particles had been formed. The supernatant liquid and the top half of the settled bed were set aside. The bottom part containing the majority of the particles over 100 μm were re-suspended in water, agglomerated, and ground in a high shear pelletizer (one liter vessel, power input 300 Watt) during one minute with 4% w of heavy fuel oil to form agglomerates. The coal particles in the agglomerates were all passing a 200 μm sieve and contained 8% w of ash. Then the agglomerates were resuspended in the remaining portion of above slurry and further agglomerated within total 20 grams of binder.

The resulting pellets, 4 to 6 mm in size, approximately 120 grams, were mixed with 100 grams of heavy fuel oil to produce a non-settling (two days' observation) suspension of coal in oil.

What we claim is:

1. A process for preparing a suspension of coal particles in a hydrocarbon fuel, comprising agglomerating an aqueous suspension of ash-containing coal particles and a binder in an agglomeration device to produce agglomerates of coal particles and binder, and an ash-containing water phase, separating the agglomerates from the ash-containing water phase and suspending the agglomerates in a hydrocarbon fuel, the agglomerates being disintegrated and the resulting coal particles becoming suspended in the hydrocarbon fuel.

2. The process of claim 1, in which the agglomerates are separated from the ash-containing water phase by passing the agglomerates and the ash-containing water phase over a sieve on which the agglomerates remain.

3. The process of claim 1 in which the agglomerates are separated from the ash-containing water phase by adding, in a separate mixing device, an amount of hydrocarbons to the agglomerate-containing water phase, so that two phases, a hydrocarbon phase and a water phase, are present in the mixing device, and the agglomerates migrate from the water phase into the hydrocarbon phase.

4. The process as of claim 1 in which, after the separation of the agglomerates from the water phase, the agglomerates are mixed with the total amount of hydrocarbon fuel.

5. The process of claim 1 in which, after the separation of the agglomerates from the water phase, the agglomerates are mixed with a portion of the total required amount of hydrocarbon fuel to obtain a thick sludge, and the thick sludge is diluted with the remainder of the hydrocarbon fuel.

6. The process of claim 1 in which the hydrocarbon fuel is a fuel based on heavy oil fractions.

7. The process of claim 1 in which the binder is taken up in the fuel.

8. The process of claim 1 in which the binder is recovered from the agglomerates and recycled.

9. The process of claim 8 in which the binder is a light hydrocarbon fraction and the fuel is a heavy fraction, and the agglomerates are mixed with the fuel at a temperature above the boiling point or range of the binder.

10. The process of claim 1 in which the hydrocarbon fuel is also used as a binder.

11. The process of claim 1 in which the agglomerates obtained after separation from the ash-containing water phase are mixed with an additional amount of water and additional binder, the agglomerates are disintegrated, the coal is re-agglomerated, and the fresh agglomerates are separated from ash-containing water and taken up in a hydrocarbon fuel.

* * * * *